US007644926B2

(12) United States Patent
Teeple

(10) Patent No.: US 7,644,926 B2
(45) Date of Patent: Jan. 12, 2010

(54) DOMINO LIKE CARD AND BOARD GAME

(76) Inventor: Tod Teeple, 5408 York Ave. South, Edina, MN (US) 55410

( * ) Notice: Subject to any disclaimer, the term of this patent is extended or adjusted under 35 U.S.C. 154(b) by 171 days.

(21) Appl. No.: 11/729,585

(22) Filed: Mar. 29, 2007

(65) Prior Publication Data

US 2007/0228655 A1 Oct. 4, 2007

Related U.S. Application Data

(60) Provisional application No. 60/787,815, filed on Mar. 30, 2006.

(51) Int. Cl.
*A63F 9/00* (2006.01)

(52) U.S. Cl. ..... 273/293; 273/153 R

(58) Field of Classification Search ..... 273/153 R, 273/156, 157 R, 160, 287, 293, 146, 264, 273/271, 275
See application file for complete search history.

(56) References Cited

U.S. PATENT DOCUMENTS 231,963 A * 9/1880 Luers ..... 273/157 R
1,752,248 A * 3/1930 Fransen ..... 273/157 R
RE25,031 E * 8/1961 Hoolim ..... 434/96
4,676,510 A * 6/1987 Agam ..... 273/292
4,699,602 A * 10/1987 Giorgi ..... 446/124
5,868,388 A * 2/1999 Wood et al. ..... 273/157 R
6,666,453 B2 * 12/2003 Chambers ..... 273/157 R
6,893,020 B1 * 5/2005 Snyder ..... 273/290
7,255,345 B2 * 8/2007 Wood et al. ..... 273/157 R

* cited by examiner

*Primary Examiner*—William M Pierce
(74) *Attorney, Agent, or Firm*—Westman, Champlin & Kelly P.A.

(57) ABSTRACT

Embodiments pertain to a game for entertainment in which players draw cards to select game pieces and then place those pieces on a game board. In one embodiment, players place their game tiles next to tiles on the board, matching pips (spots) to pips, similar to the game of dominos. Players are assessed points for every pip that's on a light-colored square of the board. The game ends when all tiles have been placed on the board. The player with the fewest points wins the game. In other embodiments players place tiles in other ways, or score points in other ways, or do not score points at all. Also, in other embodiments, there are alternative ways in which the game ends, and/or alternative ways to determine the winner.

11 Claims, 7 Drawing Sheets

DOMINO LIKE CARD AND BOARD GAME

The present application is based on and claims the benefit of U.S. provisional patent application Ser. No. 60/787,815, filed Mar. 30, 2006, the content of which is hereby incorporated by reference in its entirety.

BACKGROUND

Dominos is and has long been a very popular game. Dominos consists of a plurality of tiles, each divided into two sections. Each section has from one to nine pips (spots). There are many ways to play dominos, but the basic element of game play is to match a tile section to a another tile section with the same number of pips.

Another very popular game is checkers. Checkers consists of a board and a plurality of pieces. The board is divided into an eight-by-eight grid of squares, of two alternating colors, in what is now commonly called a "checkerboard" pattern. The pieces are round, of the same width and the same diameter. Some of the pieces are of one color, and the rest are of another color. These two colors may or may not be the same colors of the board squares. There are different ways to play checkers, but the basic element of game play is a competition between players to remove competing pieces from the board through a systematic moving of pieces from square to square.

There is always a need for new entertaining and amusing games. There is certainly a need for a game that incorporates some of the more appealing characteristics of the popular games of dominos and checkers.

The discussion above is merely provided for general background information and is not intended for use as an aid in determining the scope of the claimed subject matter. Also, the claimed subject matter is not limited to implementations that solve any or all disadvantages noted in this background section.

SUMMARY

The present invention pertains to a game for entertainment in which players draw cards to select game pieces and then place those pieces on a game board. In one embodiment, players place their game tiles next to tiles on the board, matching pips (spots) to pips, similar to the game of dominos. Players are assessed points for every pip that's on a light-colored square of the board. The game ends when all tiles have been placed on the board. The player with the fewest points wins the game. In other embodiments players place tiles in other ways, or score points in other ways, or do not score points at all. Also, in other embodiments, there are alternative ways in which the game ends, and/or alternative ways to determine the winner.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The present description will refer to various embodiments of the present invention, shown in the accompanying drawings, as including a game board and cards. The terms "board" and "card" as used herein include not just a firm board and a firm card, but also any equivalent structures made of another material (e.g., paper, cloth, wood, metal or plastic) or any electronically or computer implemented board and card.

Further, the description of various embodiments also will refer to tiles. The term "tile" as used herein includes not just a firm plastic tile, but also any equivalent structure made of another material (e.g., paper, cardboard, cloth, wood, metal, ceramic material or paper) or an electronically or computer implemented tile.

Further, the description of various embodiments also will refer to timers. The term "timer" as used herein includes not just a plastic hourglass-type sand timer, but also any equivalent structure made of another material (e.g. glass, wood or metal), a device of equivalent function (e.g., a mechanical, electric or electronic timer) or an electronically or computer implemented timer.

Figure 1:
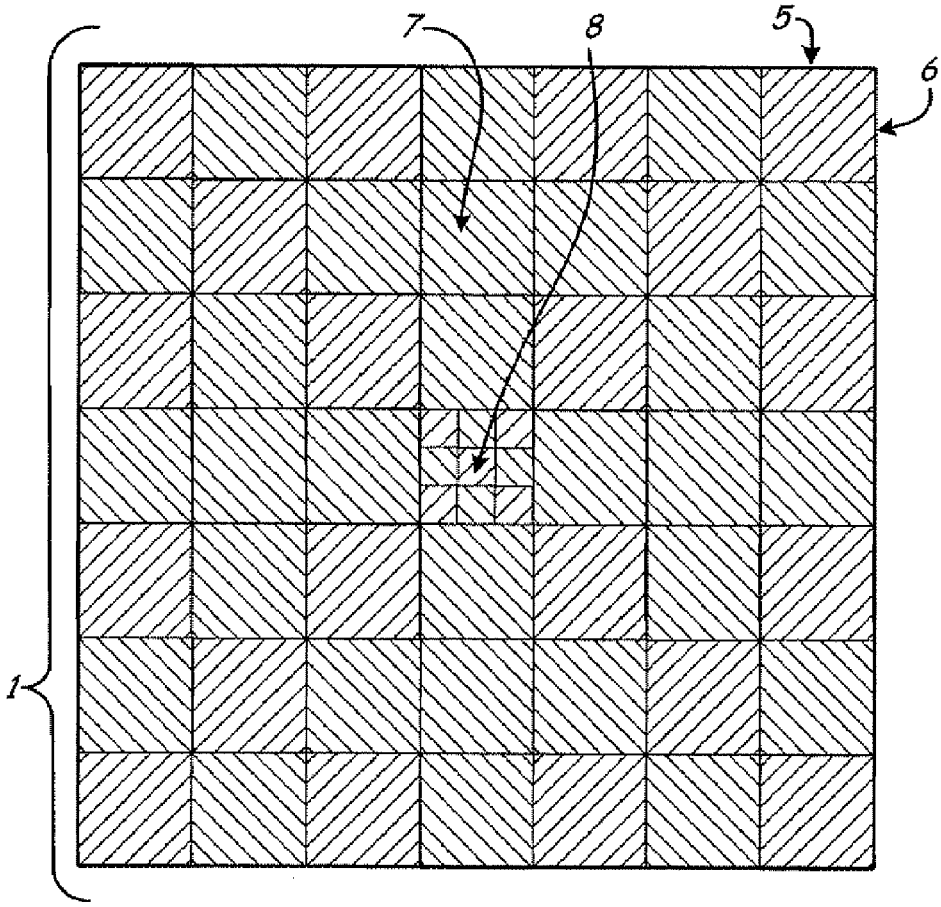
FIG. 1 is a top view of a game board.

FIG. 1 illustrates a game board 1. The board comprises a grid, seven squares wide by seven squares deep. The board is marked by 20 equidistant horizontal gridlines 6 and 20 equidistant vertical gridlines 5, which divide each square into nine sections. The squares are colored in an alternating dark-and-light checkerboard-type pattern, with these exceptions: On the second row in from each side of the board, the middle square 7 is light, rather than dark; an in the middle square of the board the sections are an alternating dark-and-light checkerboard-type pattern 8.

In other embodiments, not shown, the board grid is more or less than seven squares wide by seven squares deep. Further, the board can be marked by more or fewer than 20 vertical and horizontal gridlines or could not be marked by gridlines at all. Still further, the second row in from each side could be dark rather than light to maintain a standard checkerboard-type pattern. Those skilled in the art will appreciate that these and other simple variations are to be considered within the scope of the present invention. For example, not by limitation, in still another embodiment, the board coloration is reversed, with a light-and-dark checkerboard-type pattern, with the middle square of each second row in being dark, and the sections of the middle square being a light-and-dark checkerboard-type pattern.

Figure 2:
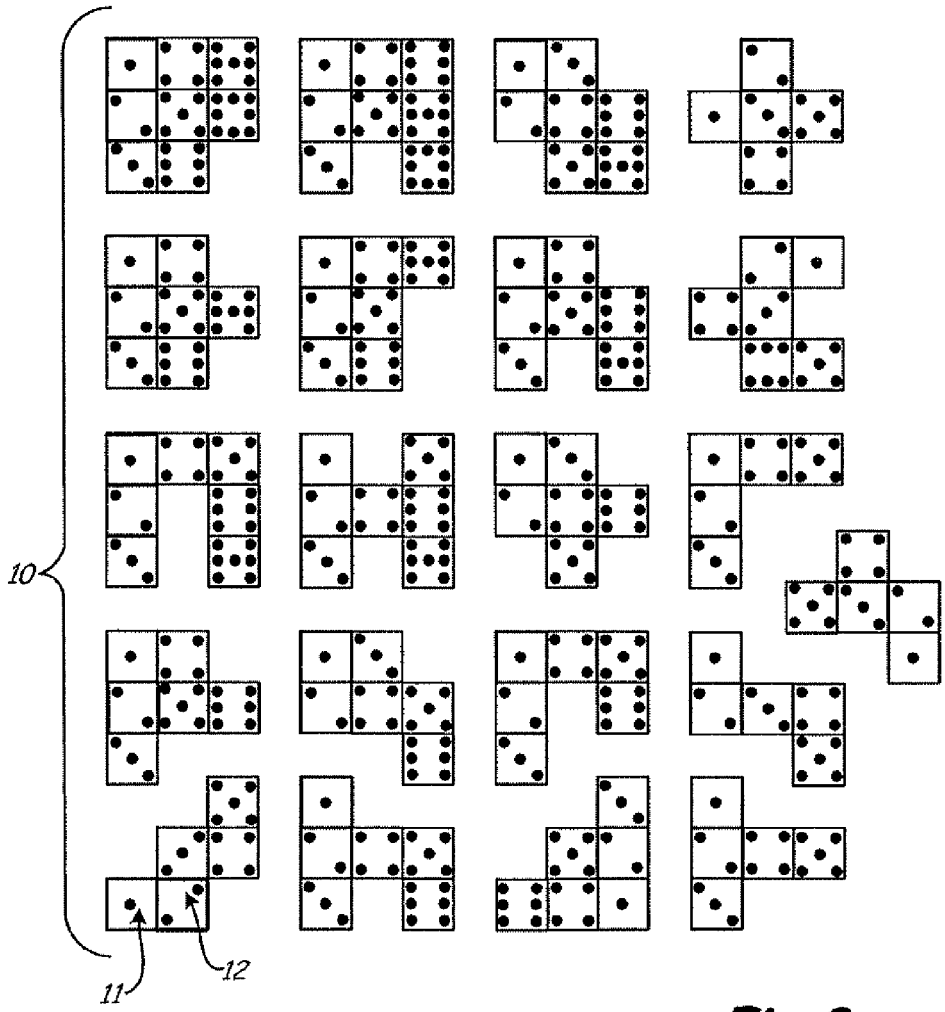
FIG. 2 is a top view of a plurality of game tiles.
Figure 3:
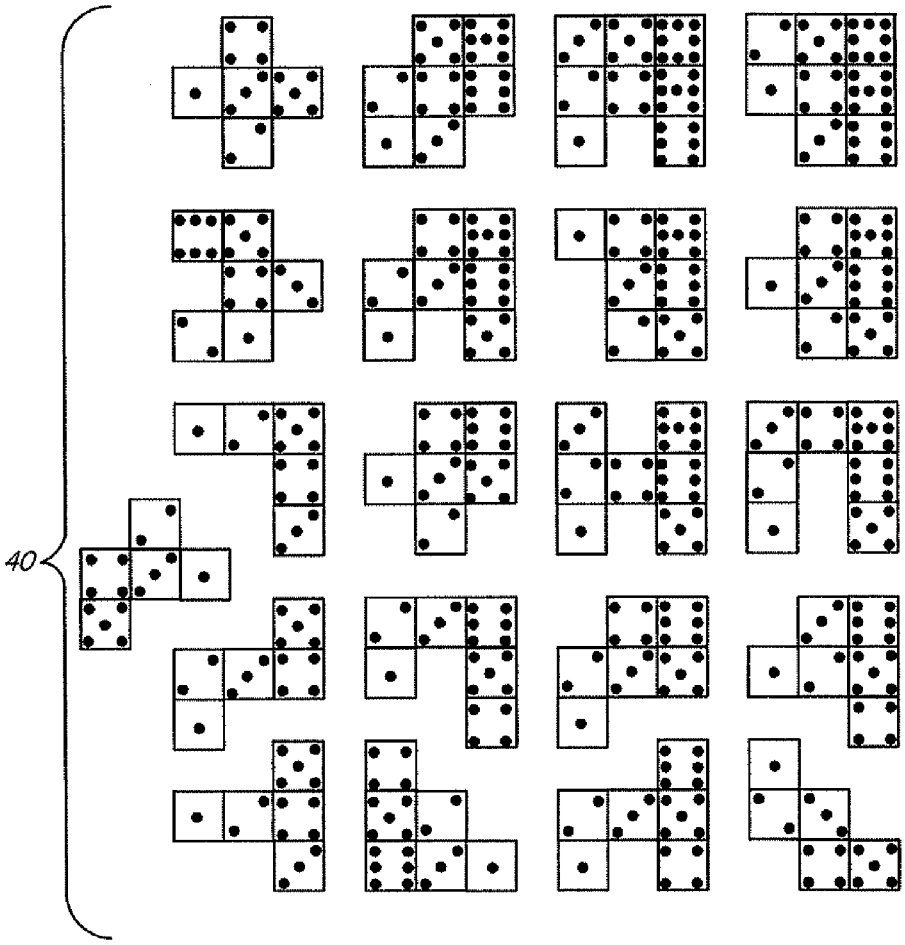
FIG. 3 is a view of the other side of the game tiles shown in FIG. 2.

FIGS. 2 and 3 together illustrate an embodiment of a plurality of game tiles (tiles 10 in FIG. 2 show one tile side and tiles 40 in FIG. 3 show the other side). Each tile is laid out in a grid that is three sections wide and three sections deep, with one or more sections removed. In one embodiment, the 21 tile shapes are made up of all but two possible variations on removing one, two, three or four grid sections while maintaining the structural integrity of the tile. The two variations not used are illustratively a tile with only the center section removed and a tile with only the center section and a corner section removed. Each section of a tile contains a number of pips (spots). In one embodiment, for one particular tile, one tile section has one pip 11, another section has two pips 12, and so on.

Those skilled in the art will appreciate that modifications can be made without departing from the scope of the present invention. For example, In another embodiment, tiles are laid out in a grid that has more or fewer than three sections on a side. In another embodiment, the tile shapes are made up of some or all possible variations on removing a section or sections. In another embodiment, and each tile section can have any conceivable combination of pip patterns.

Figure 4A:
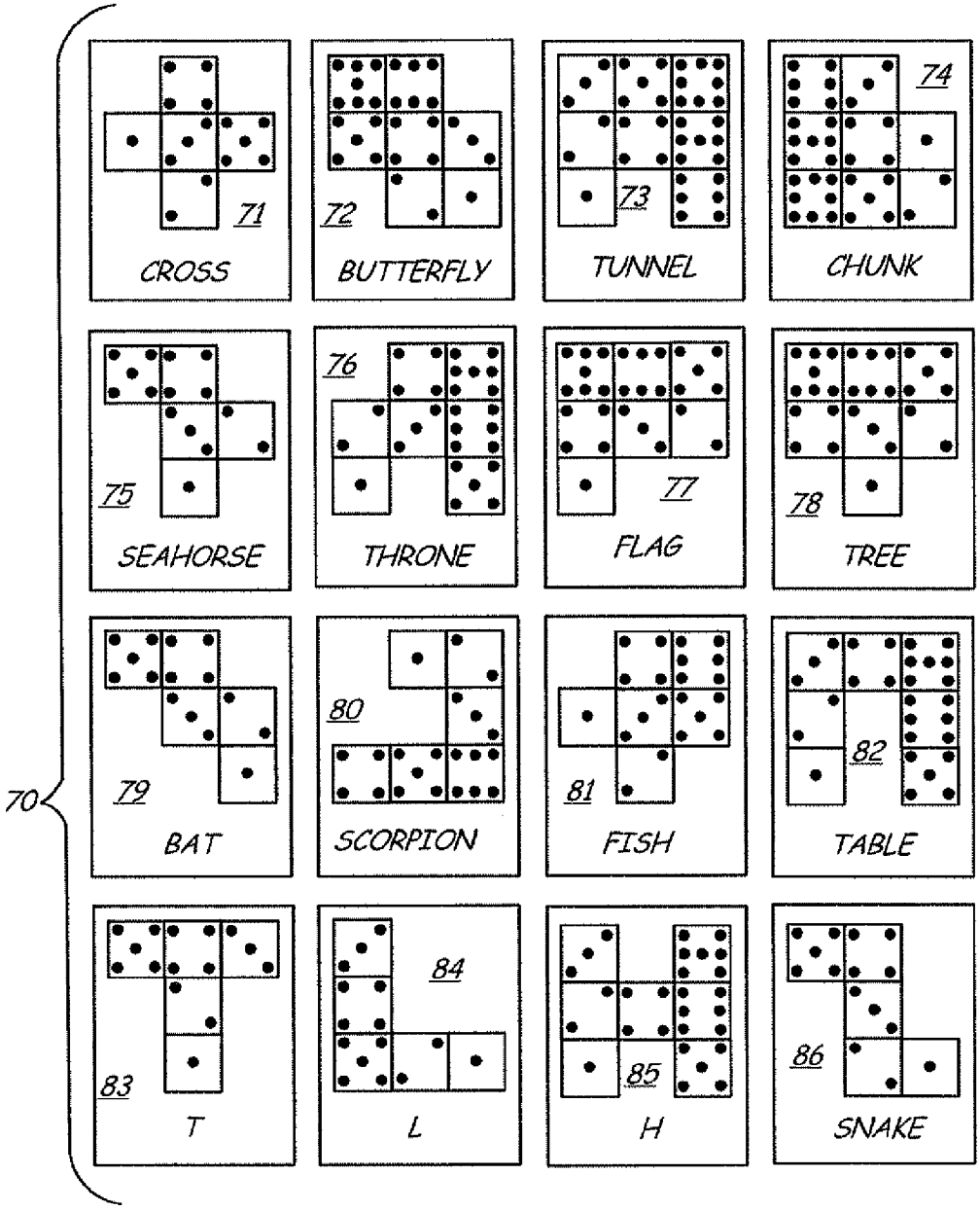
FIGS. 4*a* and 4*b* are illustrations of game cards.
Figure 4B:
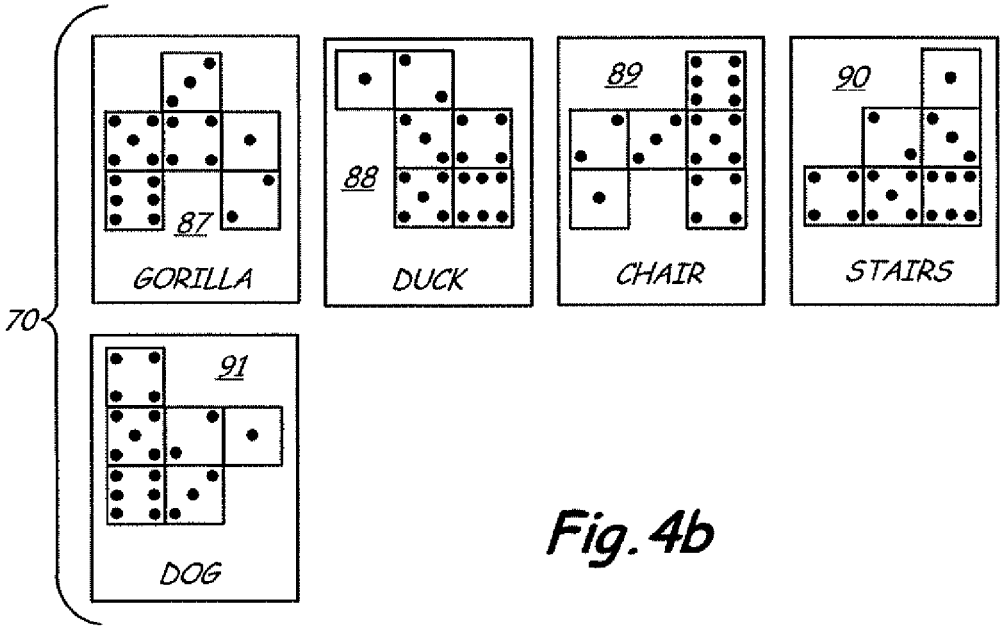

FIGS. 4*a-b* illustrate an embodiment comprising a plurality of game cards 70. Each card contains a picture of one side of a tile and the name of the tile. The back of each card is illustratively but not necessarily blank. The tile names are illustratively Cross 71, Butterfly 72, Tunnel 73, Chunk 74, Seahorse 75, Throne 76, Flag 77, Tree 78, Bat 79, Scorpion 80, Fish 81, Table 82, T 83, L 84, H 85, Snake 86, Gorilla 87, Duck 88, Chair 89, Stairs 90, and Dog 91.

Those skilled in the art will again appreciate that the scope of the present invention extends to include a variety of different variations. For example, in other embodiments, not shown, the cards display other names for the tiles, or no names at all, and the cards can have text and/or graphics on the back.

Figure 5:
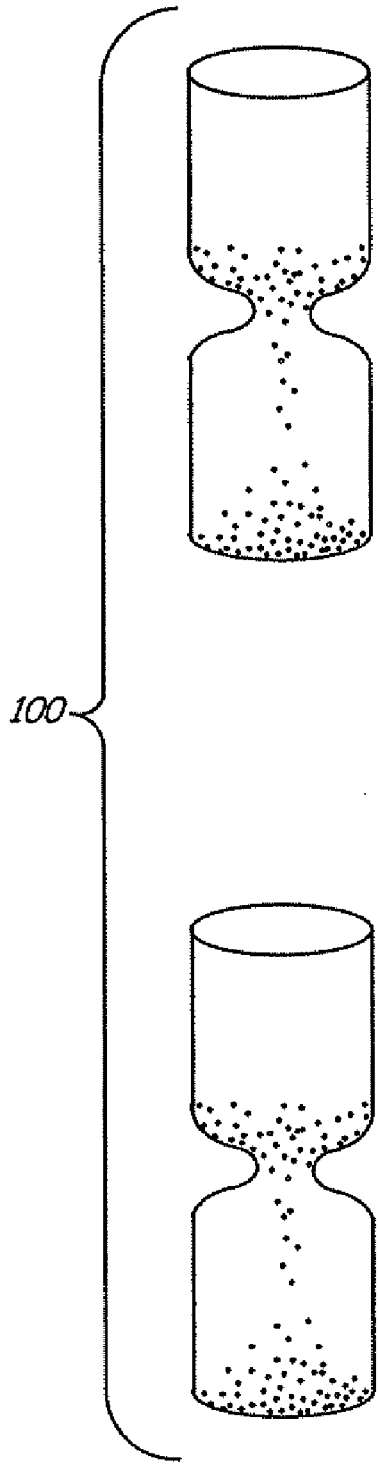
FIG. 5 is a side view of two timers.

FIG. 5 illustrates a plurality of timers 100. In one embodiment, the game is played using two one-minute hourglass timers. In other embodiments, not shown, the game is played with more or fewer times or with no timers. Of course, it is also within the scope of the present invention for the timers to be configured to measure more or less than one minute.

Figure 6:
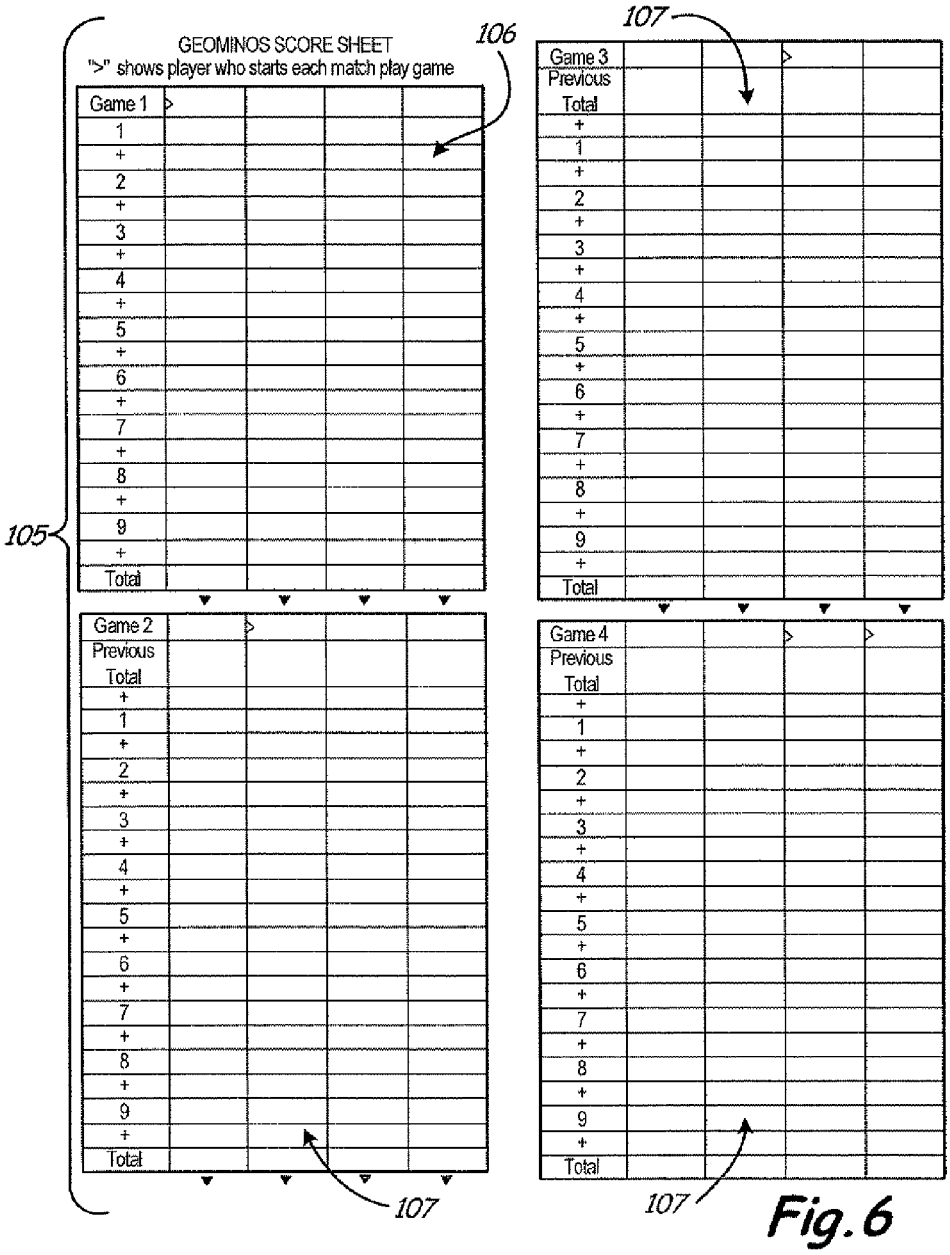
FIG. 6 is an example of a score sheet.

FIG. 6 illustrates a score sheet 105. In one embodiment, the score sheet contains a plurality of scoring grids. Each grid contains a plurality of columns. The grid for Game 1 106 contains 20 rows. The remaining grids 107 contain 22 rows. The rows in the first column illustratively contain labels indicating the game number, the score for each turn, and the running total of the score. The rows in the remaining columns are illustratively used to enter player names, score numbers and running totals.

Again, those skilled in the art will appreciate that a wide range of modifications can be made without departing from the scope of the present invention. For example, in other embodiments, not shown, a score sheet contains more or fewer grids, a grid can contain more or fewer columns or more or fewer rows, and the first column can contain other similar labels or no labels.

In one embodiment, the game of FIGS. 1-6 is intended to be played by two, three or four players. Before game play starts, the players select one of themselves to be the starting player, the players agree on which of the three methods of tile distribution they'll use (see below), the players agree on the amount of time allowed for a turn (see below), and one or more of the players shuffle the cards 70.

In other embodiments, the players can choose to play with a distribution method other than the three referred to below; can choose to allow an amount of time per turn different than the three indicated below or could choose to play without a turn time limit; and/or can choose to not shuffle the cards.

To begin play, a player illustratively draws the top card, and places the corresponding tile on the center square of the game board 8, so that the side shown on the card is face up. Since the board is symmetrical, the orientation of the center piece isn't particularly important. In another embodiments, the players are allowed to choose another method for selecting the center-square tile, or they may place this tile in another square, or they may choose to play without the starting tile. At least these variations are within the scope of the present invention.

In the preferred embodiment, there are different ways to distribute the tiles 10. The players agree on how the tiles will be distributed and play accordingly.

In one embodiment, the players begin with a starting player drawing a card and selecting the corresponding tile. Then the next player does this, and so on. In one embodiment, referred to herein as the All-Tile Game, with two or four players, the selection process continues until all the tiles are distributed; with three players, the selection process continues until each player has six tiles. In this case, two tiles will remain unplayed.

In another embodiment, referred to herein as the Five-Tile Game, the selection process continues until each player has five tiles. During the course of play, after a player places a tile on the board 1, he or she selects another tile. In this distribution method, with two players, this process continues until all tiles have been selected. With three players, after the initial five tiles are selected, each player draws only one more tile; two tiles will remain unplayed. With four players, after the initial five tiles are selected, there are no more tiles left to select.

In another embodiment, in accordance with yet another distribution method referred to herein as the One-Tile Game, no tiles are selected before play begins (except the tile for the center square). The player to the left of the starting player draws a card, selects that tile, and places it on that turn. The next player does the same thing, and so on. In this distribution method, with two or four players, this process continues until all tiles are selected and placed. With three players, this process continues until each player has selected and placed a total of six tiles. Two tiles will remain unplayed.

In other embodiments, not shown, the players may choose a distribution method other than the three referred to above.

In one embodiment, the method of play is as follows. The starting player places a tile on the board so that one of the sections of the played tile is next to a section of the center-square tile that has a matching number of pips. Placing tiles is illustratively similar to placing domino-type tiles. Matches must be side-by-side; a match cannot be made diagonally. Either side of a tile may be used. The only time the up-side of a tile has to match the card is when placing the center-square tile. No section of a placed tile can be off the game board. A player can place a tile next to any tile on the board, as long as at least one section of pips on the placed tile is next to a tile section with the same number of pips. A player's turn is done when he or she says it is, or when time runs out. The player to the left then takes a turn, and the game continues in this manner.

Again, variations can be imposed without departing from the scope of the present invention. For example, in other embodiments, players can choose other criteria for determining what is and is not a valid tile placement.

In one embodiment, a player is assessed a point for every pip in any section of their placed tile that's on a light square of the game board, with this exception: Pips on the light sections of the center square aren't counted as points. Because the player with the fewest points wins the game, a player's goal is to place each tile so that as few of its pips as possible are on a light square.

Again, rule alterations are possible and even conceived. For example in other embodiments, not shown, players may choose other circumstances that cause a player to acquire points.

In one embodiment, points are written on the score sheet 105 and subtotaled after each turn. In other embodiments, players may choose other methods of recording and/or subtotaling points, or may choose not to record points.

In one embodiment, the players agree on the time allowed for a turn (e.g., three-minute turns for beginning players, two-minute turns for intermediate players, and one-minute turns for advanced players). In one embodiment, a player illustratively must place a tile before time runs out, or be penalized (e.g., penalized five points). In one embodiment, the penalized player then gets one more minute to make a play. If the player doesn't place a tile during that time, the player forfeits the game. In other embodiments, players may choose other penalties, or no penalties, when a player's time runs out.

In one embodiment, to begin a player's turn, one of the other players starts one of the one-minute timers. A one-minute turn is over when the time runs out. For a two-minute turn, the timer is restarted as soon as it runs out. For a three-minute turn, the timer is restarted, then restarted again as soon as it runs out. In one embodiment, as soon as a player's turn is finished, the next player's turn is begun by one of the other players starting the other timer. In one embodiment, for the player who is recording the score, his or her turn is begun after that player has updated the score. In one embodiment, in the One-Tile Game, the timer is started when a player draws a card and finds that tile. The other players can help find the tile, to speed up play. In other embodiments, players could choose other methods for timing turns, or could choose not to have any time limit for turns.

The game is illustratively over when all tiles have been placed on the board (except for the two unused tiles in the three-person game). The player with the fewest points illustratively wins the game. In other embodiments, players can choose another method for determining when a game is over, and other methods for determining the winner.

In one embodiment, the game is designed to be played in match format. For two players, a match is illustratively two games, for three players it is illustratively three games, and for four players it is illustratively four games. The role of starter illustratively rotates to the left each time. In match play, the score accumulates throughout the match. At the end of the match, the player with the fewest points wins. In other embodiments, players can choose to not play in match format, or to play a differently organized match format.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A game, comprising:

a board having a first square subdivided into grid sections by horizontal and vertical lines;

a tile marked off in tile sections, each tile section being approximately the same size as a grid section; and a card that includes a depiction of the tile.

2. The game of claim 1, wherein the tile is configured to fit within the first square so as to cover some but not all of the grid sections.

3. The game of claim 1, wherein at least one of the tile sections includes at least one pip.

4. The game of claim 1, wherein all of the tile sections includes at least one pip.

5. The game of claim 1, wherein the board further comprises a second square subdivided into grid sections by horizontal and vertical lines, the second square being a different color than the first square.

6. The game of claim 5, wherein the first and second squares are approximately the same size.

7. A game, comprising:

a board having a first area of a first color subdivided into equally sized grid sections by horizontal and vertical lines, the board also having a second area of a second color subdivided into equally sized grid sections by horizontal and vertical lines, the equally sized grid sections of the first area being approximately the same size as the equally sized grid sections of the second area;

a tile marked off in tile sections, each tile section being approximately the same size as the equally sized grid section of one of the first and second areas; and a card that includes a depiction of the tile.

8. The game of claim 7, wherein the tile is configured to fit within the first area so as to cover some but not all of the grid sections.

9. The game of claim 7, wherein at least one of the tile sections includes at least one pip.

10. The game of claim 7, wherein all of the tile sections includes at least one pip.

11. The game of claim 7, wherein the first and second areas are approximately the same size.

* * * * *

UNITED STATES PATENT AND TRADEMARK OFFICE

CERTIFICATE OF CORRECTION

PATENT NO. : 7,644,926 B2
APPLICATION NO. : 11/729585
DATED : January 12, 2010
INVENTOR(S) : Tod R. Teeple It is certified that error appears in the above-identified patent and that said Letters Patent is hereby corrected as shown below:

Title Page;

Item [76] Inventor, delete "Tod Teeple" and insert --Tod R. Teeple--.

Signed and Sealed this
Twentieth Day of December, 2011

David J. Kappos

David J. Kappos
*Director of the United States Patent and Trademark Office*